United States Patent [19]

Barnhart et al.

[11] 4,317,436

[45] Mar. 2, 1982

[54] VALVE STEM SEAL

[75] Inventors: David E. Barnhart, Pontiac; Douglas R. Gates, Rochester, both of Mich.

[73] Assignee: General Motors Corporation, Detroit, Mich.

[21] Appl. No.: 92,271

[22] Filed: Nov. 8, 1979

[51] Int. Cl.[3] ..... F01L 3/08

[52] U.S. Cl. ..... 123/188 P; 277/33; 277/212 C

[58] Field of Search ..... 123/188 P, 188 GC; 277/33, 153, 162, 212 R, 212 C

[56] References Cited

U.S. PATENT DOCUMENTS

| | | | |
|---|---|---|---|
| 2,859,993 | 11/1958 | Estey | 123/188 P |
| 2,906,255 | 9/1959 | Bunce | 123/188 P |
| 3,198,188 | 8/1965 | Heid, Jr. | 123/188 P |
| 3,326,562 | 6/1967 | Deuring | 277/182 |
| 3,333,578 | 8/1967 | Muller | 123/188 P |
| 3,459,166 | 8/1969 | Updike et al. | 277/33 |

FOREIGN PATENT DOCUMENTS

| | | | |
|---|---|---|---|
| 1210247 | 2/1966 | Fed. Rep. of Germany | 123/188 P |
| 539154 | 12/1976 | U.S.S.R. | 123/188 P |

*Primary Examiner*—Craig R. Feinberg
*Assistant Examiner*—W. R. Wolfe
*Attorney, Agent, or Firm*—Arthur N. Krein

[57] ABSTRACT

A seal for the valve stem of a poppet valve in an engine includes an elongated outer tubular body and a concentric inner tubular body with both bodies being connected at one end by a radial flexible web. The inner body is provided with an annular sealing lip for sealing engagement with the stem of the valve while the free end of the outer body has an internal diameter whereby it can sealingly encircle a cylindrical valve guide on the engine for the valve. Preferably a spring is positioned to encircle the inner body whereby to maintain tension of the sealing lip against the outer peripheral surface of the valve stem. A second spring may be positioned on the outside of the tubular body to hold it to the cylindrical valve guide.

5 Claims, 3 Drawing Figures

VALVE STEM SEAL

This invention relates to a valve stem seal and, in particular, to such a valve seal for use with a poppet valve in an internal combustion engine.

Various forms of valve stem seals for use in internal combustion engines are known in the art. Such valve stem seals are used in an internal combustion engine so as to reduce the leakage of lubricating oil down through the usual minimum clearance that is provided between the outer peripheral surface of the stem of a conventional poppet valve and the internal cylindrical wall surface of a valve stem guide, such as a guide bore in the cylinder head of the engine.

The sealing ability of such prior art valve stem seals normally depends on maintaining very close manufacturing machining tolerances. Specifically, the actual sealing effectiveness of such prior art valve stem seals has normally been limited by manufacturing machining capabilities on the valve guide. That is, presently known valve stem seals require concentricities of the valve guide outside diameter to valve guide inside diameter of 0.010 inches T.I.R. (Total Indicator Reading). However, normal manufacturing machining capabilities are approximately 0.020 inches T.I.R.

As is well known, a high level of outside diameter to inside diameter run out causes a conventional valve stem seal to wear unevenly and thus permit oil to leak down through the seal. It is also known that due to the normal operating clearance that is present between the outer peripheral surface of the valve stem and its stem guide bore in the cylinder head, the axis of reciprocating movement of the valve stem will not always coincide exactly with the axis of the guide stem bore. This eccentricity will contribute to uneven wear of the valve stem seal so that after continued usage thereof, leakage of oil down through the valve stem guide will occur.

The present invention relates to a valve stem seal of fluoroelastomer material which includes an elongated outer tubular body and a concentric inner tubular body connected at one end to the outer body, the inner body having an internal cylindrical wall sized for sealing engagement with a stem of a valve while the free end of the outer body is appropriately sized so as to sealingly encircle a cylindrical extension of a boss or guide for the valve. Preferably, a first spring is positioned inside the seal to encircle the inner tubular body whereby to maintain tension thereof against the stem of the valve. A second spring is positioned on the outside of the tubular body to hold it to the exterior of a cylindrical valve guide.

It is therefore a primary object of this invention to provide an improved valve stem seal that is tolerant of high valve guide outside diameter to inside diameter run out.

Another object of the present invention is to provide an improved valve stem seal for the stem of a poppet valve in an internal combustion engine whereby the seal is adapted to adjust relative to the effective eccentricity between the stem of the valve and the outside diameter of a valve guide bushing.

A further object of the present invention is to provide an improved valve stem seal which is adapted to permit for slight relative angular movement between the stem of a valve and the associated valve guide bushing without impairing the function of the seal over an extended period of operation.

Still another object of the present invention is to provide a valve stem seal of the above type which renders it easy and inexpensive to manufacture and install and which is reliable in operation, and in other respects suitable for use on production motor vehicle engines.

For a better understanding of the invention as well as other objects and further features thereof, reference is had to the following detailed description of the invention to be read in connection with the accompanying drawings, wherein.

Figure 1:
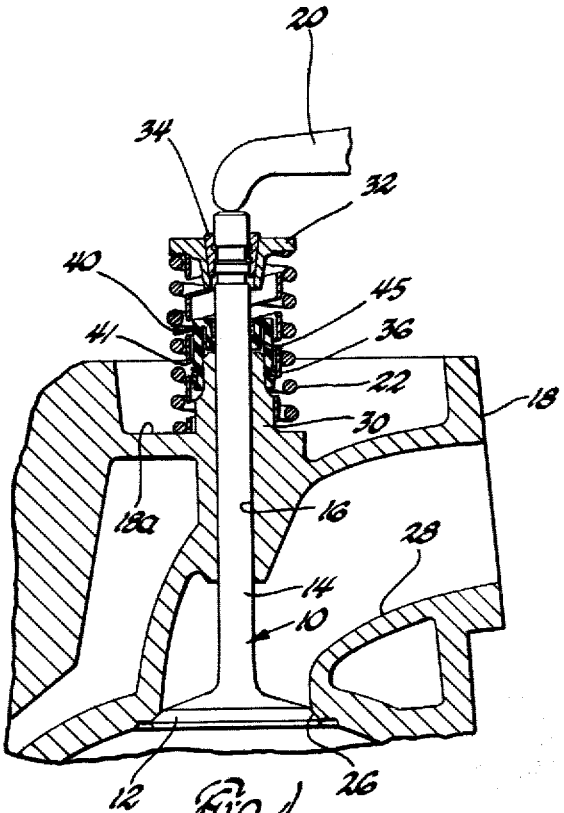
FIG. 1 is a fragmentary cross-sectional view of a portion of a valve mechanism in an internal combustion engine with the stem of the valve having a valve stem seal, in accordance with the invention operatively associated therewith, the valve being shown in elevation.

Referring now to the drawings, and in particular to FIG. 1, a conventional poppet valve 10, having a valve head 12 with a valve stem 14 extending therefrom, is mounted for reciprocation in a guide bore 16 suitably provided for this purpose in the cylinder head 18 of an engine, not shown. Valve 10 is reciprocated in a first direction, a valve opening direction, by means of a conventional engine driven valve rocker 20 acting against the top free end of the valve stem 14, which extends above the cylinder head a predetermined distance for this purpose. Valve 10 is normally biased by a coil return spring 22 in the opposite direction, a valve closing direction, whereby the head 12 thereof seats against a valve seat 26 formed in the cylinder head 18 so as to encircle the port opening of a passage 28, which may be an intake or an exhaust passage, in the cylinder head 18.

Figure 2:
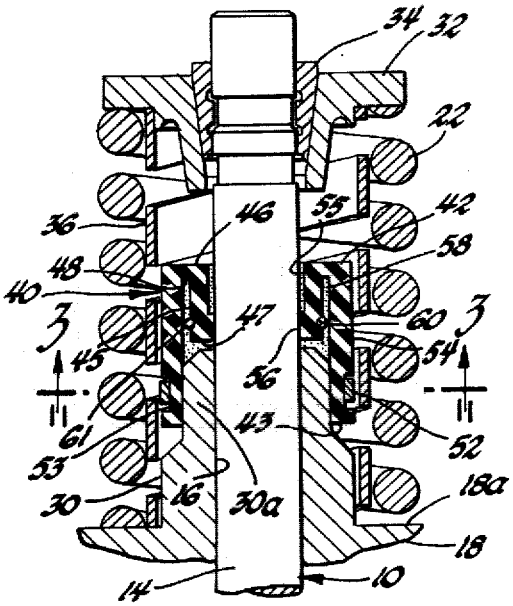
FIG. 2 is an enlarged cross-sectional view corresponding to a portion of FIG. 1 showing the valve stem and valve stem seal of the invention associated therewith; and, FIG. 3 is a perspective view of the valve stem seal per se of FIGS. 1 and 2 but with a part broken away to show the exterior of the valve stem seal.
Figure 3:
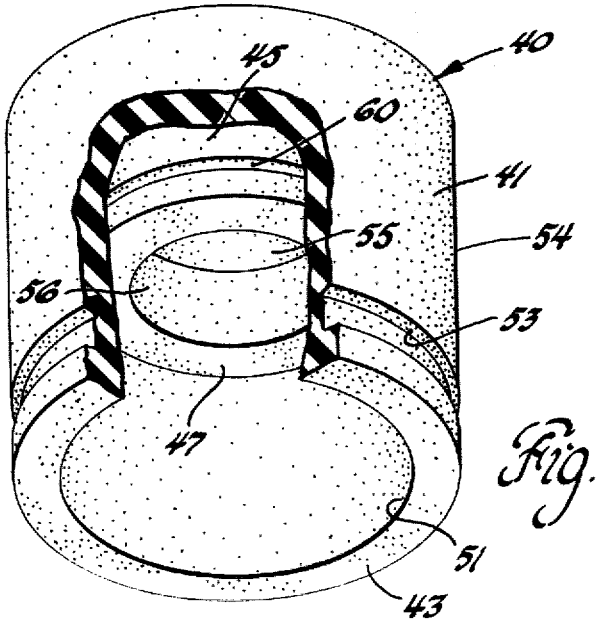

As shown in FIGS. 1 and 2, the return spring 22 loosely encircles an upstanding cylindrical guide bushing 30, which may be formed as a separate tubular bushing element inserted in the cylinder head in a conventional manner, or it may be an upstanding cylindrical boss formed integral with the cylinder head 18, as shown. The return spring 22, at its lower end, with reference to these Figures, seats against a suitable flat abutment surface **18*a* provided for this purpose on the cylinder head 18. The return spring 22 at its opposite end seats against a flanged spring retainer 32 which is fixed as by conventional wedging keepers 34 to the valve stem 14**.

In the construction shown, a coiled valve damper spring 36 is mounted in a manner similar to that of the return spring 22, but this damper spring 36 is suitably sized so that it can be positioned, as shown, directly radially inboard of and concentric to the return spring 22.

As is well known in the internal combustion engine art, the valve rocker 20 forms part of a conventional valve gear drive train used to actuate valves in an engine. Also as is well known, a valve cover, not shown, is normally secured to the cylinder head 18 to enclose the components of the valve seat drive train, and oil is supplied in a conventional manner so as to lubricate the various components thereof.

A valve stem seal, generally designated 40, constructed in accordance with the invention, is adapted to be mounted on the guide bushing 30 in position whereby a portion of the valve stem seal will slidably engage the valve stem 14 next adjacent to the guide bushing 30 whereby to prevent the flow of access oil down the valve stem toward the combustion chamber of the engine.

The valve stem seal 40 which may be of molded construction, is preferably made of a suitable fluorocarbon elastomeric material, such as VITON, a completely fluoronated fluoroelastomer, sold by Dupont, E. I. deNemours & Co., Inc., Wilmington, Del., or FLUOREL, a not-completely fluoronated fluoroelastomer, sold by 3M Company, St. Paul, Minn.

Now in accordance with the invention, the valve stem seal 40 includes a cylindrical, tubular outer skirt or body 41 having opposed axial ends 42 and 43, a cylindrical, tubular inner skirt or body 45 having opposed axial ends 46 and 47, and a relatively thin annular, radially extending washer-like flange or web 48 connecting the outer body 41 to the inner body 45 adjacent to their respective adjacent ends 42 and 46.

The internal diameter of the outer body 41 is preselected so that the cylindrical internal wall 51 of the outer body 41 can be positioned, as shown, to tightly and sealingly encircle the reduced diameter upper end 30*a* of the guide bushing 30. The outside diameter of the upper end 30*a* of the guide bushing 30 is preselected so as to be sufficiently larger than the outside diameter of an associated valve stem 14 for a purpose which will become apparent hereinafter. In addition, the axial extent of the upper end 30*a* of the guide bushing 30 is such as to permit axial room for the mounting of the valve stem seal 40 thereon. It will be apparent that, if desired, the guide bushing 30 can be of a uniform outside diameter corresponding to the outside diameter of its upper end 30*a* along the full axial extent thereof, this normally being the configuration if the valve guide bushing 30 is formed as a separate conventional guide bushing element that is then fixed to the cylinder head 18 in the usual manner.

To effect positive retention of the outer body 41 of the valve stem seal 40 to the guide bushing 30, a suitable clamp member, such as a metal split ring spring 52, is positioned in a suitable annular groove 53 provided for this purpose on the outer peripheral surface 54 of outer body 41 closely adjacent to the end 43 thereof.

Inner body 45 is provided with a stepped axial bore therethrough to define a cylindrical internal upper wall 55 and a cylindrical internal lower wall 56. The internal diameter of the upper wall 55 is sufficiently greater than the outside diameter of the valve stem 14 whereby to provide an annular clearance space therebetween. The internal diameter of the lower wall 56 is of reduced diameter relative to upper wall 55 so as to suitably correspond to the outside diameter of the valve stem 14.

Thus lower wall 56 defines, in effect, a straight sealing lip or surface which projects radially inward of the upper wall 55 for sliding engagement with the outer peripheral surface of the valve stem. Preferably, as shown, the lower wall 56 defining this sealing lip is of a suitable predetermined length so as to effect extended axial sliding and sealing contact with the valve stem 14 during reciprocating movement thereof.

The length of the lower wall 56 is preselected whereby the inner body 45 can be pivoted relative to outer body 41 by the valve stem 14. This pivotal movement of inner body 45 relative to outer body 41 is permitted by the relative flexibility of web 48, so as to align the inner body 45 whereby to compensate for any run out, within predetermined limits, of the valve stem relative to the outside diameter of guide bushing 30.

To permit this pivotal movement in any direction of the inner body 45 relative to the outer body 41, the outside diameter of the inner body is made sufficiently smaller than the inside diameter of the internal wall 51 of the outer body 41 so as to provide for an adequate annular clearance space 58 therebetween sufficient to compensate for any normal run out or non-concentricity between the outside diameter and inside diameter of guide bushing 30.

The thickness of the walls of the outer body 41 and inner body 45 are made substantially greater than the wall thickness of web 48. With this arrangement these outer and inner bodies 41 and 45, respectively, are substantially more rigid than web 48 so that if there is any run out of the outside diameter of the guide bushing to the inside diameter of bore 16 therein and therefore of the axis of reciprocation of the valve stem, pivotable movement of the inner body 45 relative to the outer body 41 will occur by flexing of the elastomeric material of web 48. However, the valve stem seal 41, as thus constructed, is still capable of accommodating the vertical forces generated by the wiping action of the valve stem 14 against the seal surface defined by wall 56 of the valve stem seal 40.

Preferably, as in the embodiment shown, the inner body 45 may be provided with an external annular groove 60 adjacent to the lower end 47 thereof and radially opposite the center of the sealing surface defined by lower wall 56 which groove 60 is adapted to receive an annular coil spring 61 used to resiliently bias the wall 56 into more effective sealing engagement with the valve stem 14 during extended usage of the engine.

With the structural arrangement of the valve stem seal 40 shown and described, the overall axial length of this seal may be made relatively small as shown, for use in certain engine applications. However with this structural arrangement, there is provided a substantially large effective working distance between the attachment of this seal to the guide bushing 30 and the contact area, that is, of sealing wall 56, of this seal to the valve stem 14. This effective working distance would correspond to and include, with reference to FIG. 2, the mean effective height of outer body 41, the mean radially width of web 48, and the mean effective height of inner body 45. This extended effective working distance has been obtained, figuratively speaking, by folding the valve stem seal 40 back inside itself to form a U-shaped section, as shown in FIGS. 1 and 2.

From the above description, it will now be apparent that a valve stem seal 40, constructed in accordance with the invention, provides a structural seal arrangement which can be made relatively compact in overall axial height but which provides an effective working distance substantially greater than the height of the actual valve stem seal. This extended effective working distance permits elements of the seal to move relative to each other in the manner described, whereby to automatically compensate for any normal run out between the outside diameter and the inside diameter of the valve guide bushing 30, so as to provide for the positive sealing of a valve stem 14 during extended engine operation.

The embodiments of the invention in which an exclusive property or privilege is claimed are defined as follows:

1. A valve stem seal for the axially reciprocable stem of a poppet valve that is slidably guided in a cylindrical valve guide bushing of an internal combustion engine, said valve stem seal including a tubular outer portion having opposite axial first and second ends; a tubular inner portion having opposite axial first and second ends; a radial web interconnecting said outer portion and said inner portion at their respective said second ends with said outer portion and said inner portion depending therefrom in concentric spaced apart relationship to each other with said outer portion encircling said inner portion; said outer portion being of an axial extent so that a portion thereof adjacent to its said first end is adapted to tightly engage around the valve guide bushing; said inner portion being of lesser axial extent than and extending within said outer tubular portion, said inner portion including an annular projecting sealing lip extending radially inward toward the valve stem next adjacent to said first end of said inner portion to define sealing means for sealingly engaging around the valve stem; and, a circular split spring ring encircling said outer portion closely adjacent to said first end to bias said outer portion into sealing engagement with the valve guide bushings, said flange web being of a thickness relative to the wall thickness of said outer portion and said inner portion so as to permit pivotal movement of said inner portion relative to said outer portion to compensate for any relatively small deviation of the axis of the poppet valve from the outer peripheral surface of the valve guide bushing.

2. A valve stem seal for the axially reciprocable stem of a poppet valve that is slidably guided in a cylindrical valve guide bushing of an internal combustion engine, said valve stem seal including a tubular outer portion having opposite axial first and second ends; a tubular inner portion having opposite axial first and second ends; a radial web interconnecting said outer portion and said inner portion at their respective said second ends so that said outer portion and said inner portion both depend from said radial web in concentric spaced apart relationship to each other; said outer portion being of an axial extent and of an internal diameter so that a portion thereof adjacent to its said first end is adapted to tightly engage around the valve guide bushing; said inner portion being of lesser axial extent than and extending within said outer tubular portion, said inner portion including an annular projecting sealing lip next adjacent to its said free end which extends radially inward toward the valve stem to define sealing means for sealingly engaging around the valve stem; a circular split spring ring encircling said outer portion closely adjacent to said first end to bias said outer portion into sealing engagement with the valve guide bushings; and, a second annular spring positioned to encircle said inner portion whereby to resiliently bias said sealing lip into sealing engagement with the valve stem, said flange web being of a thickness relative to the wall thickness of said outer portion and said inner portion so as to permit pivotal movement of said inner portion relative to said outer portion to compensate for any relatively small deviation of the axis of the poppet valve from the outer peripheral surface of the valve guide bushing.

3. A valve stem seal for the axially reciprocable stem of a poppet valve that is slidably guided in a cylindrical valve guide bushing of an internal combustion engine, said valve stem seal including a tubular outer portion having axial first and second ends; a tubular inner portion having axial first and second ends; a radial web interconnecting said outer portion and said inner portion at their respective said second ends with said outer portion and said inner portion thus depending from said radial web in concentric relationship and with said outer portion loosely encircling said inner portion; said outer portion being of an axial extent to permit a portion thereof adjacent to its said first end to be tightly engaged around the valve guide bushing; said inner portion being of lesser axial extent than and extending within said outer tubular portion, said inner portion having a stepped bore therethrough providing a first cylindrical internal wall adjacent to said web of a diameter greater than the outside diameter of the stem of the poppet valve and a second internal wall at the opposite end of said inner portion from said web, the diameter of said second internal wall conforming to the outside diameter of the stem of the poppet valve and defining an annular projecting sealing lip extending radially inward for sealingly engaging around the valve stem; and, a circular clamp means encircling said outer portion closely adjacent to said first end to bias said outer portion into sealing engagement with the valve guide bushings, said flange web being of a thickness relative to the wall thickness of said outer portion and said inner portion so as to permit pivotal movement of said inner portion relative to said outer portion to compensate for any relatively small run out of the reciprocating axis of the poppet valve relative to the outer peripheral surface of the valve guide bushing.

4. A valve stem seal for use in an internal combustion engine having the stem of a poppet valve slidably received in the guide bore of a cylindrical valve guide bushing with a portion of the stem extending axially outward of the bushing, said valve stem seal of resilient material including a circular washer-like web having a cylindrical, tubular outer skirt and a cylindrical tubular inner skirt depending therefrom in concentric spaced apart relationship to each other, said outer skirt being of a greater axial extent than said inner skirt and having an cylindrical internal wall adjacent to its said first end adapted to sealingly encircle the valve guide bushing, said inner skirt extending within said outer skirt having a cylindrical internal wall portion next adjacent to its said first end and opposite its connection to said web adapted to sealingly engage the stem of the valve above and closely adjacent to the valve guide bushing, and a circular clamp means encircling said outer skirt to bias said outer skirt into sealing engagement with the valve guide bushing, said web being of a thickness to permit movement of said inner skirt relative to said outer skirt to thus allow said inner skirt to pivot relative to said outer skirt to compensate for any deviation of the reciprocating axis of the stem of the poppet valve relative to the outer peripheral surface of the valve guide bushing.

5. A valve stem seal for use in an internal combustion engine having the valve stem of a poppet valve slidably received in the guide bore formed concentric, within normal manufacturing tolerances, in a cylindrical valve guide bushing, a portion of the valve stem extending axially outward of the bushing, said valve stem seal of resilient material including a circular washer-like web, a cylindrical, tubular outer body portion and a cylindrical tubular inner body portion both depending therefrom in concentric spaced apart relationship to each other, said outer body portion being of a greater axial extent than said inner body portion and having a cylindrical internal wall adjacent its free end adapted to sealingly encircle the valve guide bushing, said inner body portion extending within said outer body portion and having stepped cylindrical internal wall portions including a first wall portion adjacent to said web of a diameter greater than the outside diameter of the valve stem and a second wall portion, axially spaced from said web and located closely adjacent to the free end of said inner portion, which is of an internal diameter corresponding to the outside of the valve stem for sealing engagement with the valve stem closely adjacent to and above the valve guide bushing, and a circular clamp means encircling said outer body portion to bias said outer body portion into sealing engagement with the valve guide bushing, said web being of a thickness to permit pivotal movement of said inner body portion relative to said outer body portion about said web to compensate for any run out of the outer peripheral surface of the valve guide bushing relative to the guide bore therein.

* * * * *